US006191805B1

(12) United States Patent
Shimizu et al.

(10) Patent No.: US 6,191,805 B1
(45) Date of Patent: Feb. 20, 2001

(54) OPTICAL PRINTER HEAD AND OPTICAL PRINTER

(75) Inventors: Yukihiko Shimizu; Masao Saito; Kinya Ueda; Toshiaki Nakahara, all of Mobara; Shigetaka Nakamura, Wakayama; Hiromichi Morishima, Wakayama; Toshihiro Yamasaki, Wakayama, all of (JP)

(73) Assignees: Futaba Denshi Kogyo K.K., Mobara; Noritsu Koki Co., Ltd., Wakayama, both of (JP)

( * ) Notice: Under 35 U.S.C. 154(b), the term of this patent shall be extended for 0 days.

(21) Appl. No.: 09/239,552

(22) Filed: Jan. 29, 1999

(30) Foreign Application Priority Data

Feb. 2, 1998 (JP) ..... 10-021045

(51) Int. Cl.[7] ..... B41J 15/14

(52) U.S. Cl. ..... 347/241; 347/115; 347/232; 347/238

(58) Field of Search ..... 347/241, 232, 347/238, 112, 244, 227, 226, 115, 122, 120; 250/235; 248/178; 313/495, 497, 306, 308, 585, 586

(56) References Cited

U.S. PATENT DOCUMENTS 4,601,452 * 7/1986 Rando ..... 248/178
5,084,616 * 1/1992 Morimoto ..... 250/235
5,592,205 * 1/1997 Shimizu et al. ..... 347/232

* cited by examiner

*Primary Examiner*—N. Le
*Assistant Examiner*—Lamson D. Nguyen
(74) *Attorney, Agent, or Firm*—Oblon, Spivak, McClelland, Maier & Neustadt, P.C.

(57) ABSTRACT

A printer head capable of increasing intensity of dot-like light irradiated onto a record medium without requiring to increase a drive voltage or the number of printer heads arranged. The optical printer head includes a luminous element including two luminous dot arrays arranged in parallel to each other at a predetermined interval in a sub-scanning direction. The luminous dot arrays each are constituted of a plurality of luminous dots which have a dimension in the sub-scanning direction increased by a predetermined magnification as compared with that in a main scanning direction and are spaced from each other at identical intervals in the main scanning direction. The luminous dots of the two luminous dot arrays are arranged in an offset manner while being deviated from each other in the main scanning direction by a distance equal to the dimension thereof in the main scanning direction. Also, a reduction optical system is arranged for carrying out irradiation of light emitted from the luminous dots while reducing a dimension of the light in the sub-scanning direction by a reciprocal of the predetermined magnification.

5 Claims, 8 Drawing Sheets

OPTICAL PRINTER HEAD AND OPTICAL PRINTER

BACKGROUND OF THE INVENTION

1. Field of the Invention

This invention relates to an optical printer used for forming an image on a record medium such as a photosensitive film or the like, for example, in a color video printer or the like and a printer head used therefor, and more particularly to a printer head which includes luminous lines having luminous dots arranged thereon and in which light exposure is carried out while permitting dot-like light from the luminous lines to be superposed on a record medium, to thereby form an image thereon and an optical printer including such a printer head.

2. Discussion of the Background

The assignee proposed an optical printer which is so constructed that a fluorescent luminous tube acting as a luminous element is used as a printer head to form an image on a record medium such as a photosensitive film or the like. The printer head constituted by the fluorescent luminous tube, as shown in FIG. 11, includes a number of luminous dots arranged in two rows in an offset manner. The luminous dots each are formed into a square configuration of sides having a length a. The luminous dots of each of the rows are arranged at intervals a in a main scanning direction. The luminous dots of the rows adjacent to each other are arranged so as to be spaced from each other at pitches P (=a) in the main scanning direction and at a pitch b (=4*a*) in a sub-scanning direction. The rows are arranged so as to extend in parallel to each other.

The printer heads designated at reference numeral 101 in FIG. 12 each include a box-like envelope, in which a number of anodes each including a phosphor layer are arranged to form luminous dots. An optical printer shown in FIG. 12 includes three such printer heads 101. Luminous dot arrays of each of the printer heads 101 include a main scanning direction defined in a horizontal direction or a direction perpendicular to a plane of FIG. 12 and a sub-scanning direction defined in an upward vertical direction or a vertical direction on the plane of FIG. 12. The luminous dot arrays are arranged in a manner to be parallel to each other at a predetermined interval while keeping positions thereof in the main scanning direction and those in the sub-scanning direction coincident with each other. Dot-like light emitted from the luminous dots of each of the printer heads is directed forwardly in the horizontal direction. The printer heads each are provided on a side thereof facing a substrate with an image-formation optical system 104 constituted of a mirror 102 and a selfoc lens array (SLA) 103, so that a light path of light emitted from each of the printer heads 101 is perpendicularly shifted in a downward vertical direction. The optical printer also includes red, green and blue color filters R, G and B arranged below the selfoc arrays 103, respectively. In the conventional optical printer shown in FIG. 12, the luminous dots of the printer heads 101 each are made of a ZnO:Zn phosphor, which exhibits a considerably expanded luminous spectrum, so that such an arrangement of the color filters R, G and B permits dot-like light of each of red, green and blue luminous colors to be irradiated onto a record medium 105 which is arranged below the color filters R, G and B. The record medium 105 is arranged so as to be moved in the sub-scanning direction or a lateral direction in FIG. 12 relatively to dot-like light emitted from each of the printer heads 101.

During a recording operation, the record medium 105 is moved in the sub-scanning direction relatively to light emitted from the printer heads 101. Data on an image decomposed into red, green and blue colors are fed to the printer heads 101 corresponding in color thereto, so that the two-row luminous dots of each of the printer heads 101 are driven for luminescence at predetermined timings in synchronism with relative movement of the record medium 105 described above. Such driving permits light emitted from the luminous dots arranged in two rows and in an offset manner to be irradiated in the form of a single straight line parallel to the main scanning direction on the record medium 105, so that irradiation of light beams from the printer heads 101 to the printer head 101 while being superposed on each other leads to formation of a full-color image on the record medium 105.

The selfoc lens arrays 103 of the image-formation optical system described above, as shown in FIG. 13, form an erected real image of an equi-magnification on the record medium 105. Thus, dot-like light emitted from the luminous dots forms the image on the record medium 105 without changing a configuration thereof or while keeping the configuration unvaried.

In order to increase the quantity of light in the conventional optical printer or printer heads constructed as described above, it would be considered to increase an anode voltage of the printer head or arrange two or more printer heads of the same luminous color. Unfortunately, an increase in anode voltage of the printer head requires to increase dielectric strength of a driver IC for driving the printer head, leading to an increase in manufacturing cost of the printer head. Also, such an increase in the number of printer heads as described above likewise causes an increase in manufacturing cost. Thus, the approaches each are an obstacle to a reduction in manufacturing cost, resulting in failing to be successfully employed to increase manufacturing cost.

In particular, the optical printer including the printer heads respectively exhibiting red, green and blue luminous colors has a disadvantage that the red luminous color is generally decreased in light quantity or intensity as compared with the green and blue luminous colors, so that a full-color image formed is deteriorated in color balance, leading to a failure in reproduction of natural color. This would be due to the fact that a red color ingredient contained in light emitted from the ZnO:Zn phosphor is reduced in light intensity as compared with the remaining color ingredients.

SUMMARY OF THE INVENTION

The present invention has been made in view of the foregoing disadvantage of the prior art.

Accordingly, it is an object of the present invention to provide a printer head which is capable of increasing intensity of dot-like light irradiated onto a record medium without requiring to increase a drive voltage or the number of printer heads arranged.

It is another object of the present invention to provide a printer head which is capable of increasing intensity of light of a luminous color of which light intensity is relatively reduced such as a red luminous color, resulting in being suitable for use for an optical printer in which a full-color image is formed by means of a plurality of printer heads different in luminous color from each other.

In accordance with one aspect of the present invention, an optical printer head is provided. The optical printer head includes a luminous element including a plurality of luminous dots which have a dimension in a sub-scanning direction increased as compared with that in a main scanning direction and are spaced from each other at predetermined intervals in the main scanning direction. Also, the optical printer head includes a reduction optical system for carrying out irradiation of light emitted from the luminous dots of the luminous element while reducing a dimension of the light in the sub-scanning direction.

Also, in accordance with this aspect of the present invention, an optical printer head includes a luminous element including two luminous dot arrays arranged in parallel to each other at a predetermined interval in a sub-scanning direction. The luminous dot arrays each are constituted of a plurality of luminous dots which have a dimension in the sub-scanning direction increased by a predetermined magnification as compared with that in a main scanning direction and are spaced from each other at identical intervals in the main scanning direction. The luminous dots of the two luminous dot arrays are arranged in an offset manner while being deviated from each other in the main scanning direction by a distance equal to the dimension thereof in the main scanning direction. Also, the optical printer head includes a reduction optical system for carrying out irradiation of light emitted from the luminous dots of the luminous element while reducing a dimension of the light in the sub-scanning direction by a reciprocal of the predetermined magnification.

In accordance with another aspect of the present invention, an optical printer is provided. The optical printer includes a record medium on which an image is formed by irradiation of light, a plurality of luminous elements different in luminous color from each other for selectively irradiating dot-like light from a plurality of luminous dots arranged in a main scanning direction to the record medium, a transfer means for transferring the luminous elements and record medium relatively to each other in a sub-scanning direction, and a control means for driving the transfer means and luminous elements in synchronism with each other. The luminous elements include a luminous element of a specific luminous color which emits dot-like light reduced in sensitivity as compared with luminous elements of other luminous colors. The luminous element of the specific luminous color includes a plurality of luminous dots which have a dimension in the sub-scanning direction increased as compared with that in the main scanning direction and a reduction optical system for carrying out irradiation of light emitted from the luminous dots while reducing a dimension of the light in the sub-scanning direction.

In a preferred embodiment of the present invention, the luminous elements include phosphors of red, green and blue luminous colors, respectively. The luminous element of the specific luminous color exhibits a red luminous color.

In a preferred embodiment of the present invention, the luminous elements each are a fluorescent luminous element including luminous dots each having a phosphor containing red, green and blue luminous color ingredients. The luminous elements each emit dot-like light through filters of red, green and blue colors. The luminous element of the specific luminous color exhibits a red luminous color.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
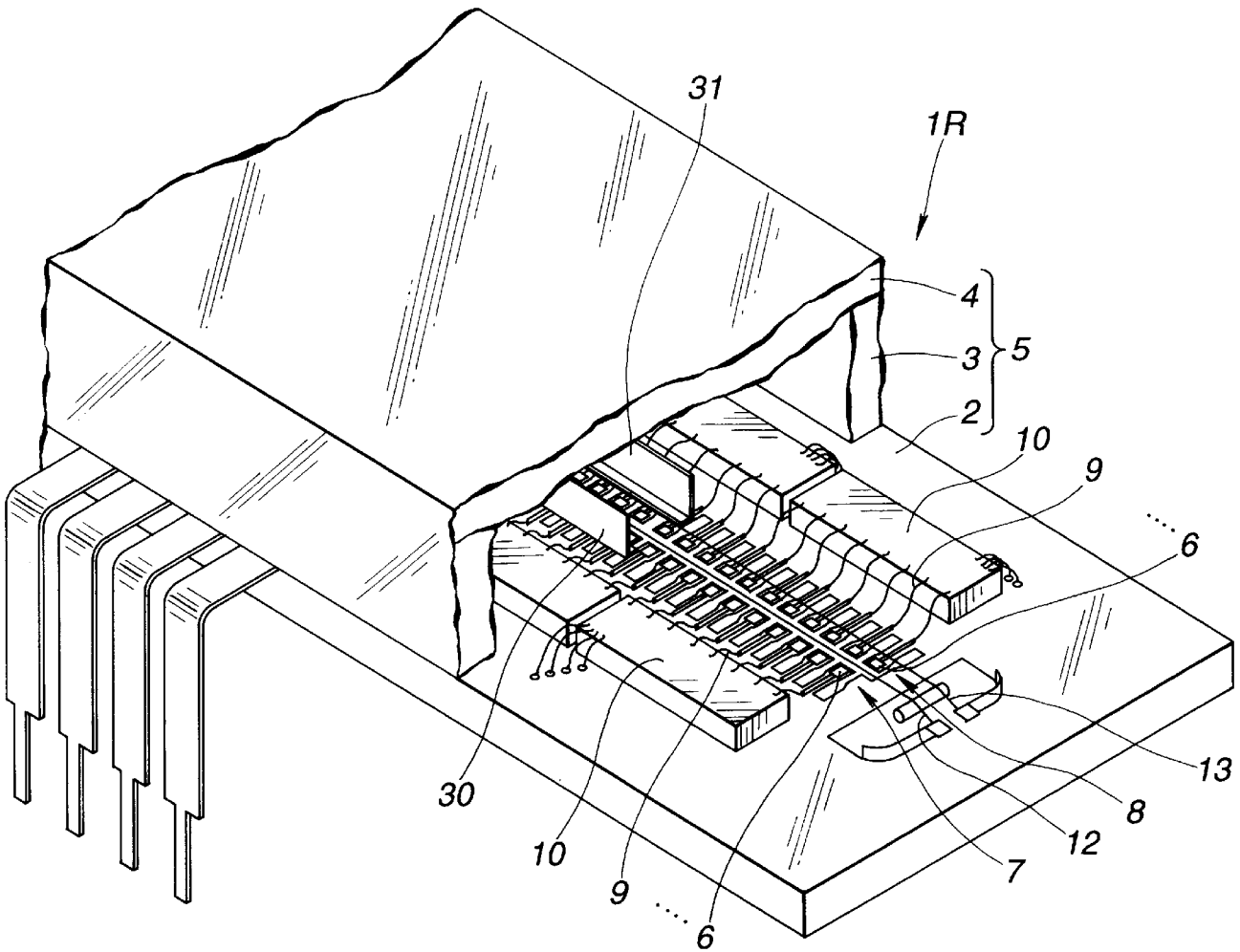
FIG. 1 is a fragmentary partly cutaway perspective view showing an embodiment of a printer head according to the present invention.

Now, the present invention will be described hereinafter with reference to FIGS. 1 to 10.

Referring first to FIGS. 1 to 4, an embodiment of an optical printer according to the present invention is illustrated. An optical printer of the illustrated embodiment includes three printer heads 1R, 1G and 1B. Herein, the printer heads are not only individually designated at 1R, 1G and 1B but generally commonly designated at reference numeral 1. The printer heads 1R, 1G and 1B include luminous dots exhibiting a red luminous color, a green luminous color and a red luminous color, respectively. Light emitted from each of the printer heads is irradiated onto a film 20 acting as a record medium, resulting in an image being formed thereon.

Now, the printer head IR exhibiting a red luminous color will be described by way of example while representing the printer heads 1. The printer head 1 includes an envelope 5 of a box-like shape formed by joining an anode substrate 2, side plates 3 and a rear substrate 4 to each other by means of sealing glass. Then, the envelope thus formed is evacuated to a high vacuum.

Figure 2:
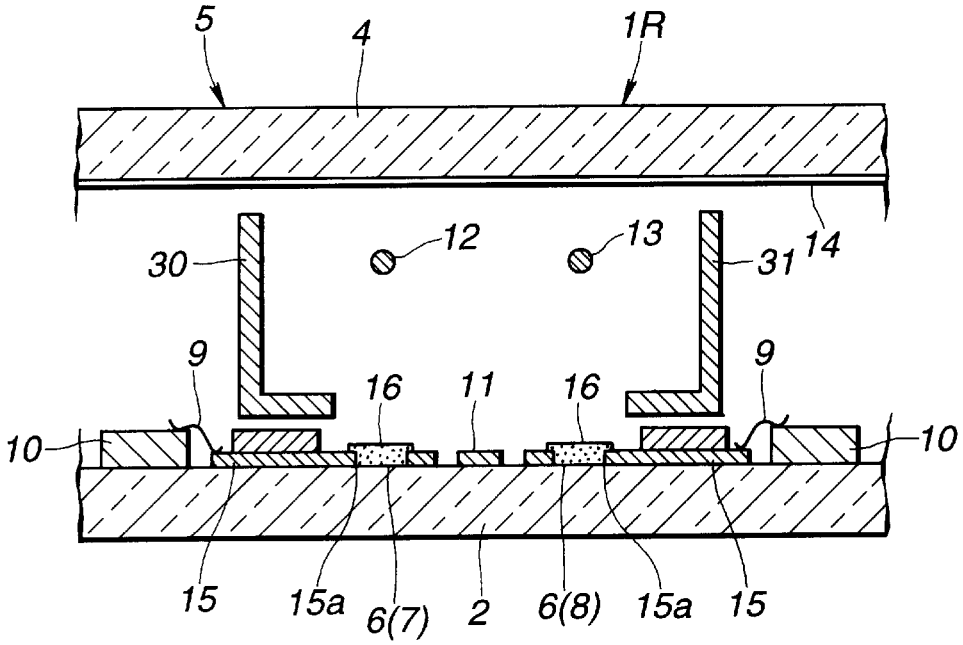
FIG. 2 is a fragmentary sectional view of the printer head shown in FIG. 1.

The anode substrate 2 is provided on an inner surface thereof with a first luminous dot array 7 and a second luminous dot array 8 in a manner to extend in a longitudinal direction of the anode substrate 2. The luminous dot arrays 7 and 8 each include a plurality of luminous dots 6. The luminous dots 6, as shown in FIG. 2, each include a frame-like conductive film 15 made of aluminum or the like and arranged on the anode substrate 2 and a phosphor layer 16 deposited on the frame-like conductive film 15. In the illustrated embodiment, the phosphor layer 16 is made of a ZnO:Zn phosphor. The phosphor layer 16 is deposited so as to extend beyond or all over a rectangular opening 15*a* of the frame-like conductive film and not to overflow the frame-like conductive film 15. Luminescence emitted from the phosphor layer 16 is outwardly discharged from the opening 15*a* of the frame-like conductive film 15 through the anode substrate 2. Thus, an area of each of the luminous dots 6 of the printer head 1 indicates an effective luminous area of the phosphor layer 16 defined by the opening 15*a* of the frame-like conductive film 15. The luminous dots 6 of the first and second luminous dot arrays 7 and 8 are led out through anode conductors 9 to an outside of the luminous dot arrays 7 and 8 and then connected to ICs 10 arranged in the envelope 5, respectively.

Figure 3:
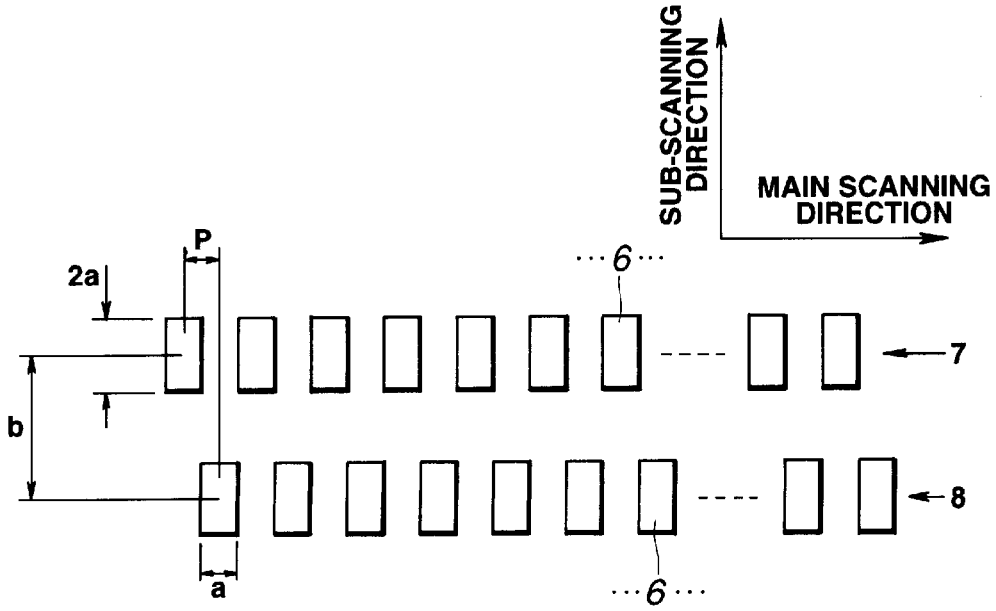
FIG. 3 is a schematic plan view showing luminous dots incorporated in the printer head of FIG. 1.

Now, a configuration of the luminous dots 6 and arrangement of the first and second luminous dot arrays 7 and 8 will be described with reference to FIG. 3. The luminous dots 6, as shown in FIG. 3, are formed into a rectangular shape which has short sides of a in length defined in a main scanning direction or a longitudinal direction of the substrate 2 and long sides of 2a in length defined in a sub-scanning direction. The first and second luminous dot arrays 7 and 8 each are constituted of a number of luminous dots 6 arranged in the main scanning direction. The luminous dots 6 of each of the luminous dot arrays 7 and 8 are spaced from each other in the main scanning direction at intervals a equal to the length of the short side of the luminous dots and pitches 2a twice as large as the length. The first and second luminous dot arrays 7 and 8 are arranged in parallel to each other and at a predetermined pitch b in the sub-scanning direction perpendicular to the main scanning direction. In the illustrated embodiment, the pitch b is set to be equal to 4a. Also, the luminous dots 6 of the first and second luminous dot arrays 7 and 8 are arranged in an offset manner while being deviated from each other by a distance a in the main scanning direction.

The pitch b of the two luminous dot arrays 7 and 8 in the sub-scanning direction is defined to be 4a, resulting in being anintegral times as large as a pitch P of the luminous dots 6 in the main scanning direction.

The anode substrate 2 is provided on an upper surface thereof or the inner surface thereof with a plain control electrode 11. The plain control electrode 11 is formed of a conductive film of aluminum or the like and arranged in the same plane as the luminous dots 6 while surrounding the luminous dots 6, anode wirings 9 and the like. During driving of the optical printer, a positive voltage is kept constantly applied to the plain control electrode 11, resulting in an electric field in proximity thereto being kept constant.

The optical printer of the illustrated embodiment also includes a first filamentary cathode 12 and a second filamentary cathode 13 provided in the envelope 5, which are stretchedly arranged above the first luminous dot array 7 and second luminous dot array 8 in a manner to extend along the arrays 7 and 8 or in the main scanning direction, respectively. The rear substrate 4 is formed on an inner surface thereof with an antistatic light-permeable film or nesa film 14. The nesa film 14 is formed on a front surface thereof with an anti-reflection layer, which functions to absorb light from the anodes to prevent the light from being reflected toward the anodes by the nesa film 14. Absence of such an anti-reflection layer causes the light to be reflected toward the anodes by the nesa film 14, resulting in a leakage luminescence through a gap between abode conductors and the plain control electrode 11, leading to a deterioration in contrast of display.

Further, the optical printer of the illustrated embodiment includes a first shield electrode 30 arranged in the envelope 5 in a manner to be positioned outside the luminous dot array 7 and first cathode 12. Also, a second shield electrode 31 is arranged in the envelope 5 so as to be positioned outside the luminous dot array 8 and second cathode 13. The shield electrodes 30 and 31 each are formed of a plate material of a substantially L-shape in section as viewed in a plane perpendicular to the main scanning direction and arranged in such a manner that a flange plate section thereof is rendered parallel to the front surface of the anode substrate 3. The flange plate section of each of the shield electrodes 30 and 31 is positioned above the anode substrate 2 with a microgap being defined therebetween. In the illustrated embodiment, the microgap is defined to be about 0.3 mm or less. Alternatively, the flange plate section may be arranged above the anode substrate 2 through an insulating layer interposed therebetween. Also, the shield electrodes 30 and 31 are so arranged that an upper end thereof is positioned above the cathodes 12 and 13. Thus, the cathodes 12 and 13 are surrounded by both shield electrodes 30 and 31. The shield electrodes 30 and 31 thus arranged function to prevent a reactive current from flowing to the wirings of the luminous dots 6, a wiring of the plain control electrode 11 and the like to deteriorate uniform luminescence. Also, a width of an opening defined between the shield electrodes 30 and 31 may be controlled or restricted to reduce a reactive current flowing to the plain control electrode 11 and luminous dots 6.

Figure 11:
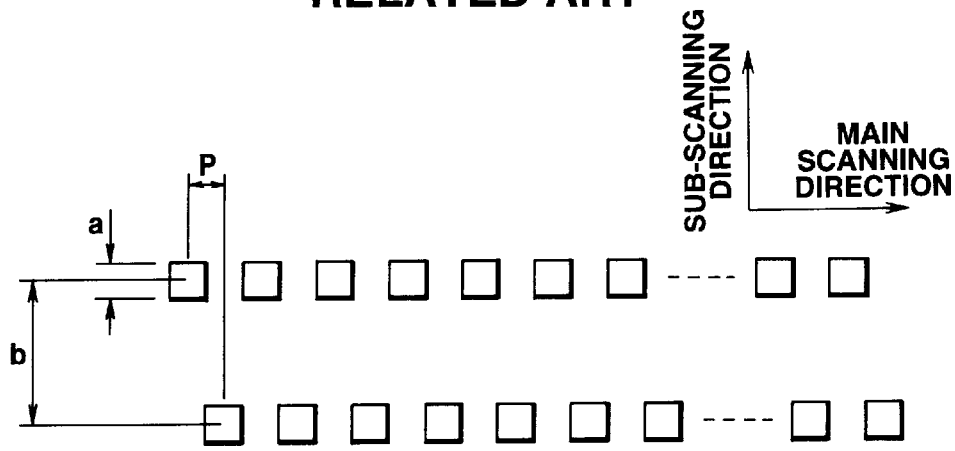
FIG.11 RELATED ART
FIG. 11 is a plan view showing arrangement of luminous dots in a conventional printer head.
Figure 12:
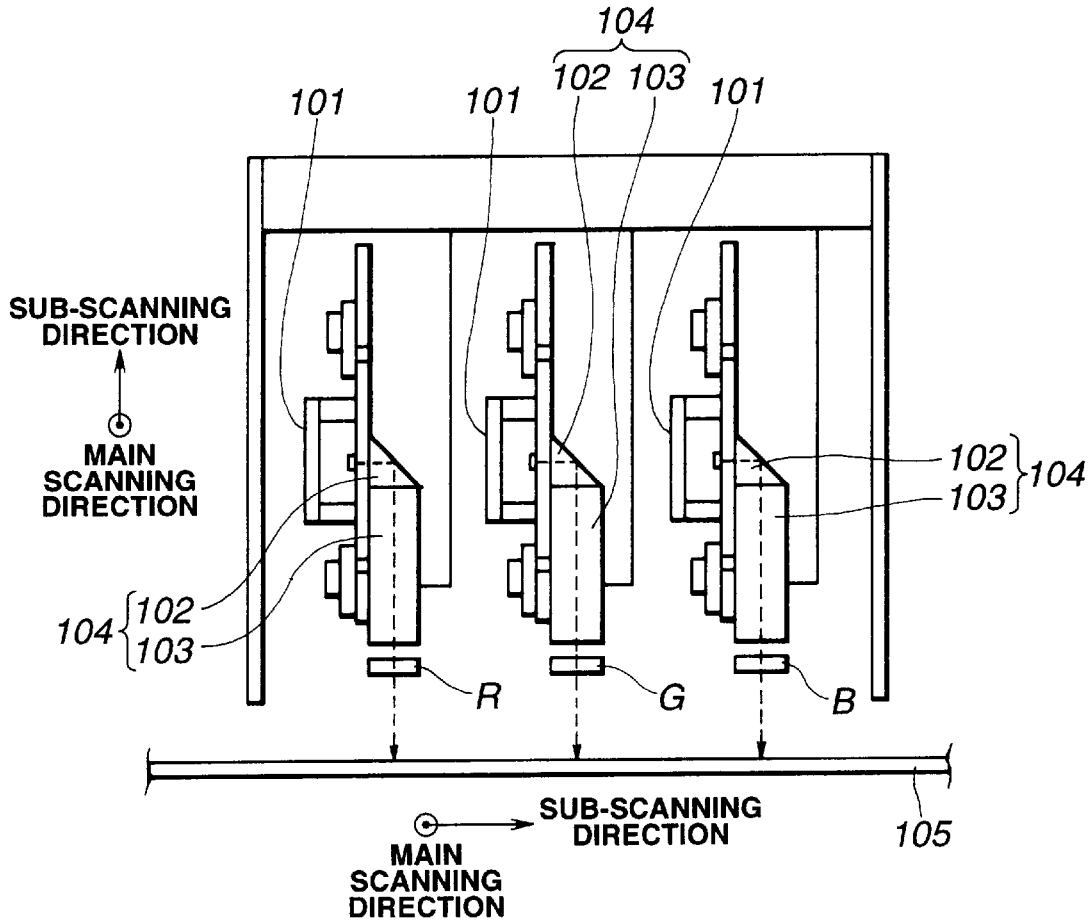
FIG.12 RELATED ART
FIG. 12 is a side elevation view generally showing a printer head incorporated in a conventional optical printer.
Figure 13:
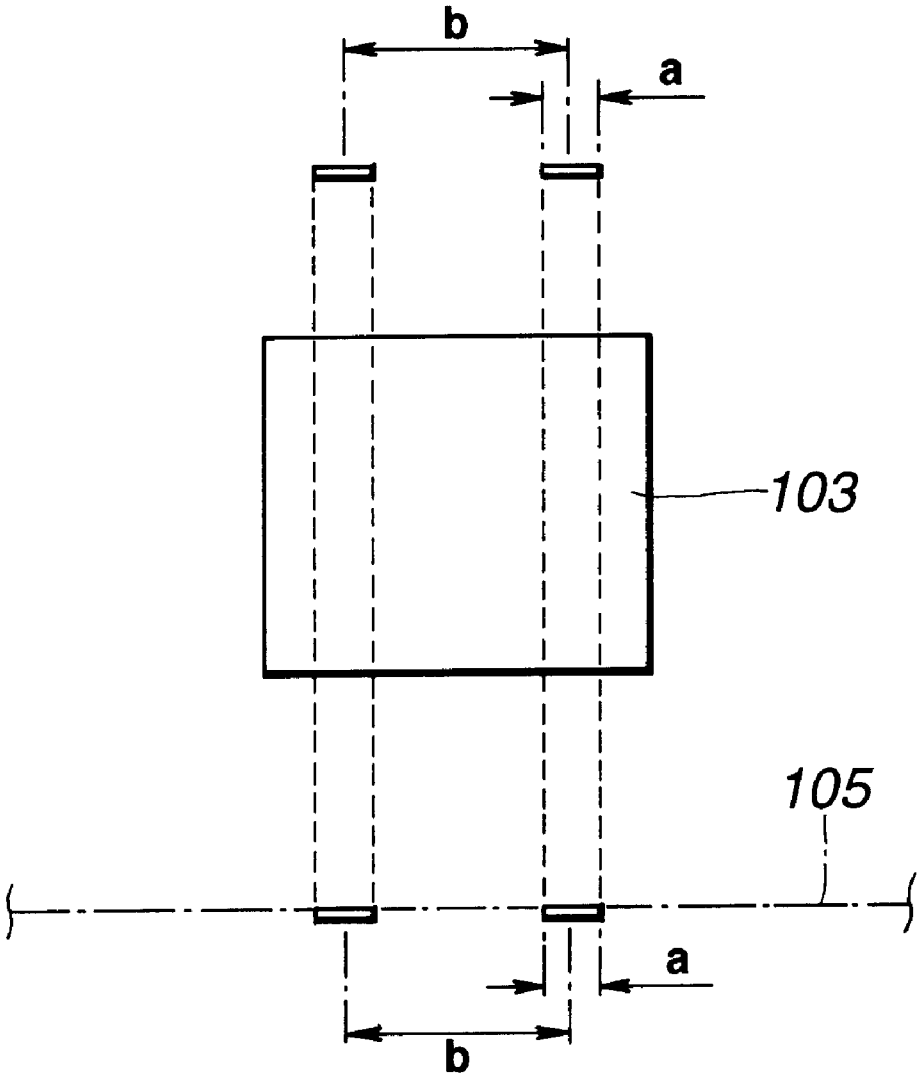
FIG.13 RELATED ART
FIG. 13 is a diagrammatic view showing relationship between luminous dots and an optical system in a conventional printer head.

Now, the remaining printer heads 1G and lB incorporated in the optical printer of the illustrated embodiment will be described. The printer heads 1G and 1B are constructed so as to irradiate dot-like light of a green luminous color and that of a blue luminous color to the record medium. The printer heads 1G and 1B are constructed in substantially the same manner as the printer head 1R except both are somewhat different in a configuration of luminous dots and arrangement thereof. The luminous dots of the printer heads 1G and 1B are constructed in substantially the same manner as those in the prior art described above with reference to FIG. 11. Thus, the luminous dots are formed into a square shape of which one side has a length a and arranged so as to be spaced from each other at intervals a and pitches a in the main scanning direction. Also, the luminous dots are arranged in two rows at a pitch b=4a in the sub-scanning direction and in an offset manner.

Figure 4:
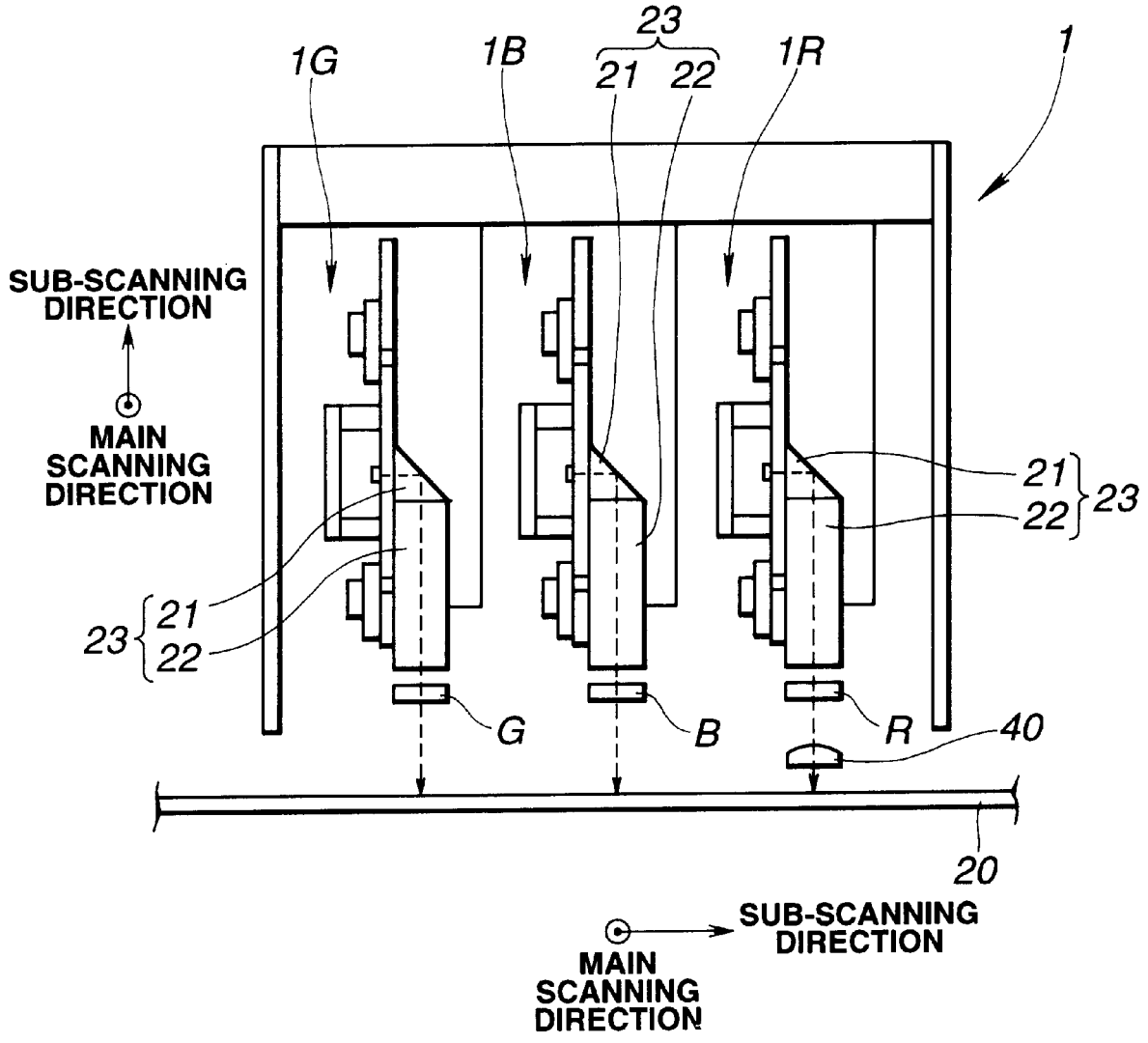
FIG. 4 is a side elevation view generally showing the printer head of FIG. 1.
Figure 5:
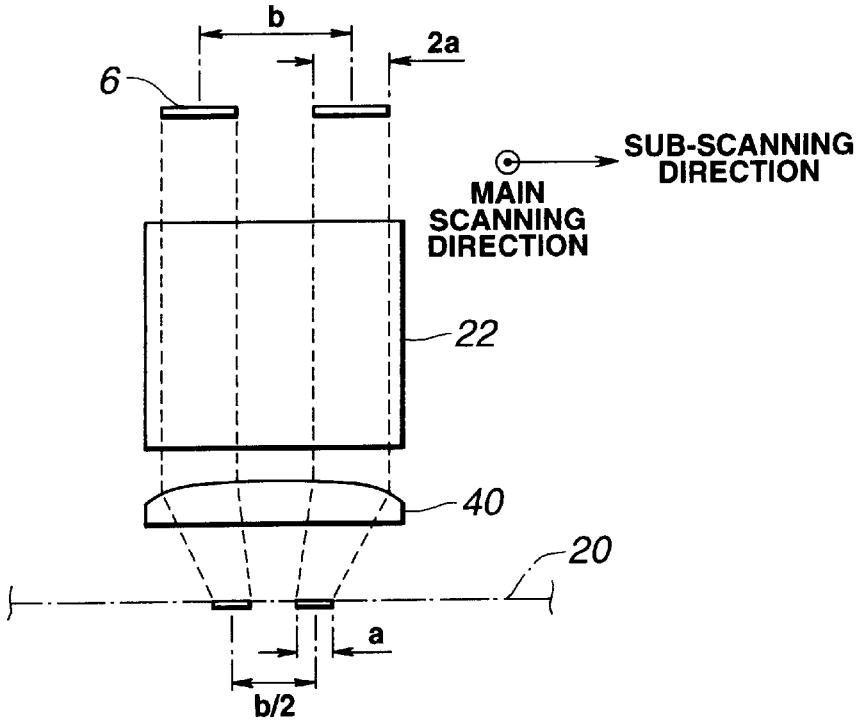
FIG. 5 is a diagrammatic view showing relationship between luminous dots and a reduction optical system in the printer head shown in FIG. 1.

In the luminous dot arrays of each of the three printer heads 1R, 1G and 1B, as shown in FIG. 4, the main scanning direction is defined in a horizontal direction or a direction perpendicular to a plane of FIG. 4 and the sub-scanning direction is defined in a vertical direction or an upward direction in the plane of FIG. 4. Also, the printer heads 1R, 1G and 1B are arranged so as to be spaced from each other at predetermined intervals while being in parallel to each other. Thus, dot-like light emitted from the luminous dots of each of the printer heads 1R, 1G and 1B is directed or irradiated forwardly in the horizontal direction or in a right-hand direction in FIG. 4 through the light-permeable substrate. The printer heads 1R, 1G and 1B each are provided on a front surface side of the substrate thereof with an image-formation optical system 23 constituted of a prism 21 and a selfoc lens array 22. The image-formation optical system 23 has a focus position defined at the opening 15*a* of the frame-like conductive film 15 and a projected image position defined on a photosensitive surface of the film 20, resulting in forming an erected real image of an equi-magnification on the film 20. Dot-like light emitted forwardly of the anode substrate 2 from the printer head 1 perpendicularly changes an optical path thereof, resulting in being guided downwardly in the vertical direction. Thus, the luminous dots have a horizontal direction or a direction perpendicular to the plane of FIG. 4 defined in the main scanning direction and a horizontal direction or a right-hand direction defined in the sub-scanning direction on the photosensitive surface of the horizontal film 20 acting as the record medium.

The optical printer of the illustrated embodiment also includes red, green and blue color filters R, G and B arranged below the selfoc lens arrays 22, respectively. The green and blue color filters G and B are arranged in a manner to be directly opposite to the record medium or film 20 with a predetermined interval being defined therebetween. The red color filter R has a cylindrical surface lens 40 which acts as a reduction optical system arranged therebelow in a manner to be positioned between the red color filter R and the film 20. The cylindrical surface lens 40 is so constructed that a part of a surface thereof acts as a part of a cylindrical surface. The cylindrical surface lens 40 is so arranged that the cylindrical surface is positioned so as to face the color filter R and a central axis of the cylindrical surface is rendered parallel to the main scanning direction.

The cylindrical surface lens 40 functions to permit the light from the luminous dots of the print head 1R of a red luminous color to be irradiated onto the record medium while keeping a dimension of the light in the main scanning direction unvaried and reducing that in the sub-scanning direction to one half. Now, the manner of operation of the reduction optical system will be described with reference to FIG. 5, wherein the main scanning direction is defined so as to be perpendicular to a plane of FIG. 5 and the sub-scanning direction is defined in a right-hand direction in the plane. This permits a dimension of the luminous dots in the sub-scanning direction irradiated onto the film 20 to be reduced from 2a to a and the interval in the sub-scanning direction or the pitch between the rows to be reduced from b=4a to b/2 or 2a, so that the dimension may be rendered equal to a dimension of the luminous dots of each of the printer heads 1G and 1B in the sub-scanning direction.

During recording on the record medium or film 20, the film 20 is moved relatively to light emitted from the printer heads 1. Image data decomposed into the red, green and blue colors are fed to the printer heads 1R, 1G and 1B, respectively, resulting in driving of the luminous dots of each of the printer heads arranged in two rows in synchronism with the above-described relative movement of the film 20. Such driving permits light of the luminous dots of each of the printer heads 1 arranged in two rows in an offset manner to be irradiated in the form of a single straight line parallel to the main scanning direction on the record medium, resulting in a full-color image being formed on the record medium 20.

In the illustrated embodiment, the printer head 1R of a red luminous color is formed into an area twice as large as that of each of the printer heads 1G and 1B. Thus, dot-like light of a red luminous color irradiated to the film 20 is reduced to a square shape of which one side has the same length a as each of the green light and blue light, however, intensity thereof may be increased to a level two or three times as much as that in the prior art. This prevents intensity of the red luminous color from being reduced as compared with that of the green and blue luminous colors, to thereby ensure satisfactory balance among the luminous colors.

Figure 6:
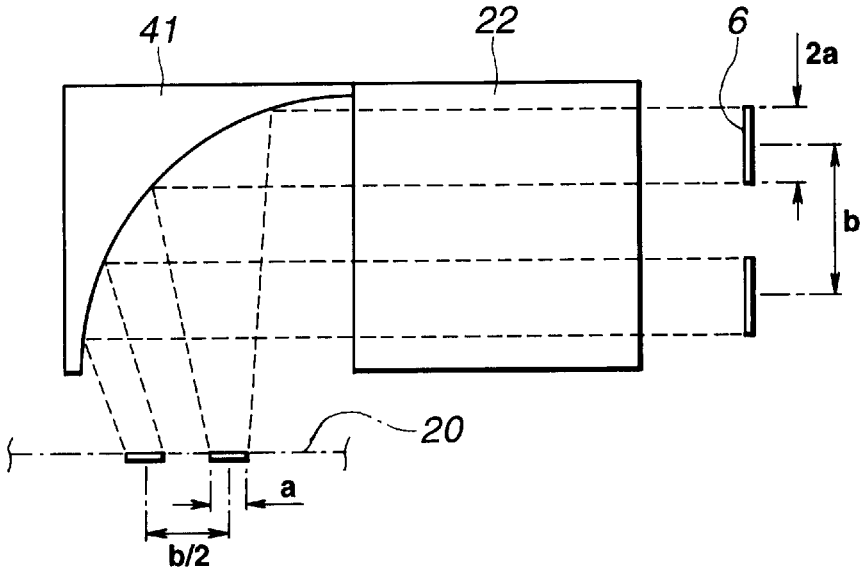
FIG. 6 is a diagrammatic view showing another relationship between luminous dots and a reduction optical system in the printer head of FIG. 1.
Figure 7A:
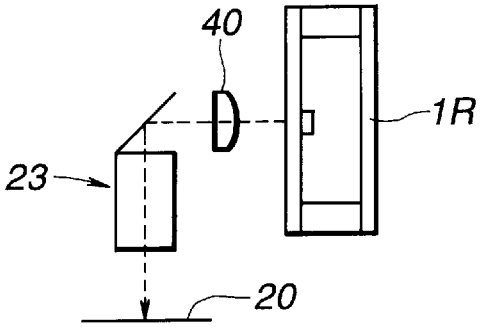
FIGS. 7(*a*) to 7(*d*) each are a schematic view showing arrangement of luminous dots and a reduction optical system in the printer head of FIG. 1.
Figure 7B:
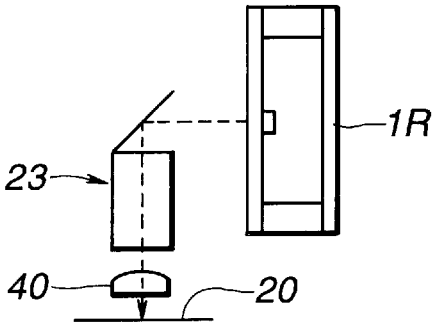
Figure 7C:
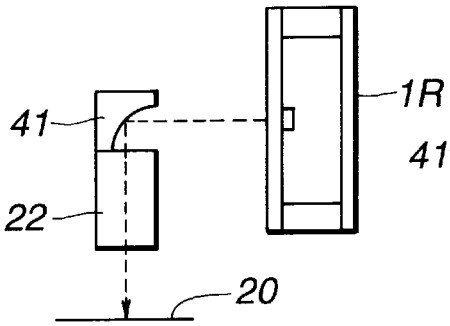
Figure 7D:
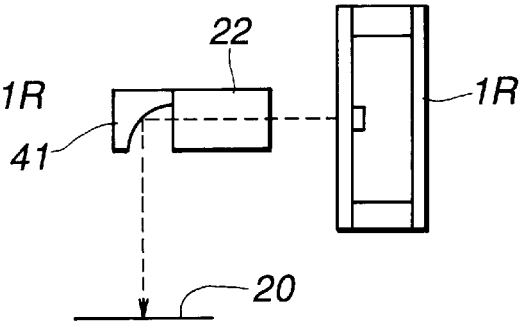

In the illustrated embodiment, the reduction optical system is constituted by the cylindrical surface lens 40. Alternatively, in the present invention, the reduction optical system may be constructed of such a reflection mirror as shown in FIG. 6. More particularly, the reduction optical system shown in FIG. 6 includes a combination of a selfoc lens array 22 and a cylindrical surface concave mirror 41. Such a construction permits an optical path to be changed by an angle of 90 degrees while ensuring that the reduction optical system exhibits the same function as described above, so that a position of the record medium 20 or the like with respect to the printer heads 1 may be suitably adjusted depending on such a change of the optical path.

Arrangement of the printer head 1R and reduction optical system may be carried out as shown in FIGS. 7(*a*) to 7(*d*) by way of example, wherein FIG. 7(*b*) shows the arrangement described above with reference to FIGS. 1 to 4. The cylindrical surface lens 40 may be arranged in front of the image-formation optical system 23 as shown in FIG. 7(*a*). FIG. 7(*d*) shows the arrangement described above with reference to FIG. 6, wherein light emitted from the luminous dots is guided through the selfoc lens array 22 and then reflected by the concave mirror 41. Alternatively, the light may be guided through the selfoc lens array 22 after it is reflected by the concave mirror 41. Also, a change of the optical path may be carried out by arranging a plane mirror in the middle of the optical path.

In the illustrated embodiment, the selfoc lens array 22 is used as the optical element for forming an erected real image of an equi-magnification. Alternatively, a plastic lens array, a roof mirror leans array (RMLA) or the like may be effectively used for this purpose.

Also, in the illustrated embodiment, the filters R, G and B are arranged while using ZnO:Zn which exhibits a relatively wide spectrum range as the phosphor, leading to luminescence of the respective luminous colors. Thus, the illustrated embodiment is constructed so as to increase an area of the luminous dots of a red luminous color relatively reduced in intensity to a level twice as large as that of the remaining luminous dots and irradiate the luminous dots of a red luminous color to the record medium while reducing them to ½ which is a reciprocal of the above-described magnification or magnitude. Alternatively, a (Zn,Cd)S:Ag,Cl phosphor may be used for the luminous dots of a red luminous color. In this instance, intensity of the luminous dots of green and blue luminous colors and that of a red luminous color ingredient in a luminous or emission spectrum of the (Zn, Cd)S:Ag,Cl phosphor are compared with each other to suitably determine a magnification at which an area of the luminous dots of a red luminous color is increased. In the (Zn,Cd)S:Ag,Cl phosphor, an increase in ratio of Cd to Zn leads to an increase in red luminous color ingredient. For example, a $(Zn_{0.22},Cd_{0.78})$S:A g,Cl phosphor emits light of a reddish orange luminous color. Also, any other phosphors containing a red luminous ingredient in an emission spectrum thereof may be likewise used for the luminous dots of a red luminous color.

A magnification or enlargement ratio of a luminous area of the luminous dots of a specific luminous color to that of the luminous dots of the remaining luminous colors and a reduction ratio of the luminous dots of the specific luminous color obtained by the reduction optical system may be suitably set depending on characteristics of the phosphor and filters. For example, when the phosphors exhibiting red, green and blue luminous colors are used for the printer heads for red, green and blue luminous colors, respectively, luminance of a specific luminous color, for example, a red luminous color may possibly be decreased as compared with that of the remaining luminous colors. In this instance, the illustrated embodiment may be so constructed that a dimension of the luminous dots of the specific luminous color such as, for example, a red luminous color in the sub-scanning direction is enlarged at a predetermined magnification and light of the luminous dots is irradiated onto the record medium through the reduction optical system in which a reduction ratio in the sub-scanning direction is set to be a reciprocal of the above-described multiple. Such construction permits the luminous dots of the specific luminous color to have the same configuration as the luminous dots of the other luminous colors, to thereby significantly eliminate a difference in luminance among the luminous colors.

Also, the enlargement ratio and reduction ratio depend on not only characteristics of the phosphor and filters but sensitivity of the record medium for every color. Thus, it is required that enlargement of an area of the luminous dots of the specific luminous color and a reduction ratio of the reduction optical system as described above are determined in view of a whole situation including characteristics of the phosphor and filters and a sensitivity of the record medium for every luminous color.

Figure 8:
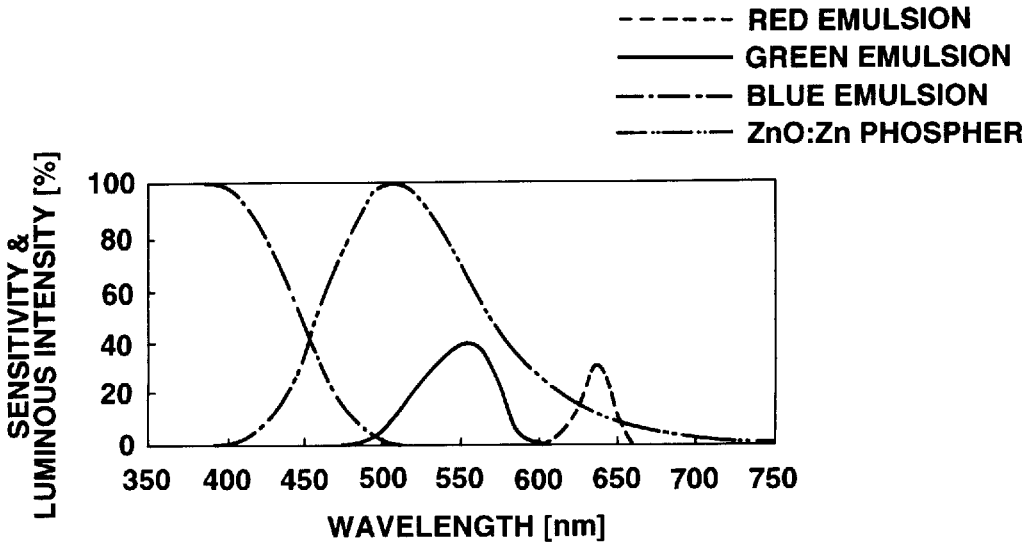
FIG. 8 is a graphical representation showing an emission spectrum of a phosphor (ZnO:Zn phosphor) arranged in a fluorescent luminous tube incorporated in an optical printer and sensitivity characteristics depending on colors of emulsions for a color film by way of example.

More specifically, sensitivity of the film, transmittance of the filters and luminance of the light source are varied depending on red, green and blue luminous colors of the optical printer. FIG. 8 shows an emission spectrum of the phosphor (ZnO:Zn phosphor) incorporated in the printer head of the optical printer of the illustrated embodiment and characteristics of sensitivity of each of emulsions for the color film by way of example. As will be noted from FIG. 8, light emitted from the phosphor of the printer head contains a green ingredient in a relatively large amount and the color film exhibits increased sensitivity with respect to green and blue.

Figure 9:
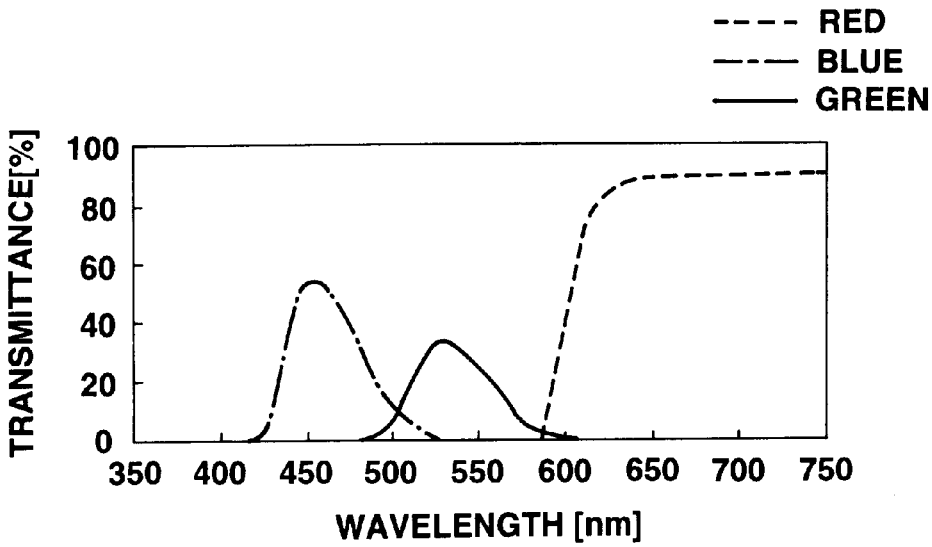
FIG. 9 is a graphical representation showing spectral transmittance of color filters incorporated in an optical printer of the present invention.

FIG. 9 shows spectral transmittance of each of the filters R, G and B of the optical printer. In FIG. 8, light of a red luminous color is decreased in intensity and sensitivity as compared with light of each of green and blue luminous colors, whereas in FIG. 9, light of a red luminous color is increased in spectral transmittance as compared with light of the other luminous colors.

Figure 10:
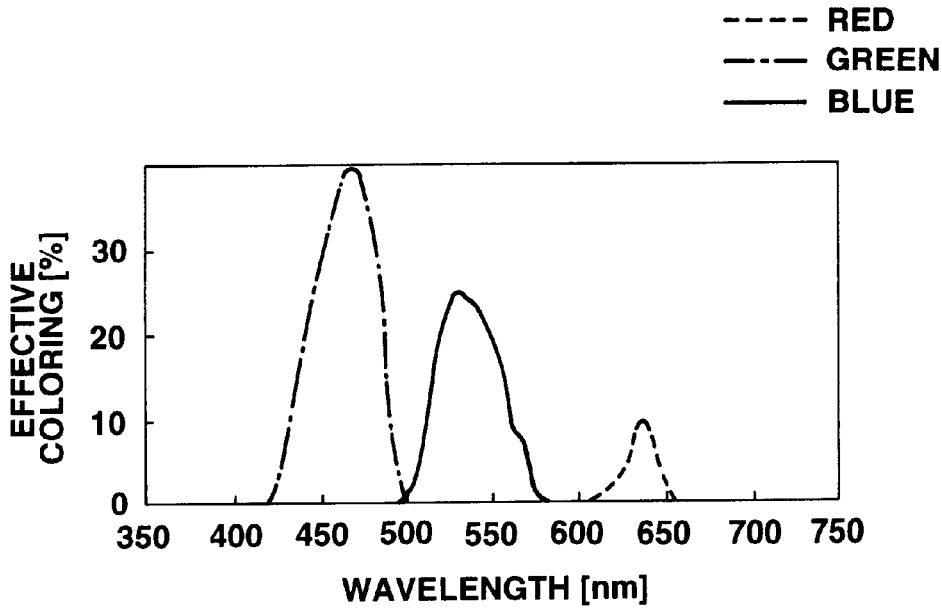
FIG. 10 is a graphical representation showing relationship between wavelengths and coloring in an optical printer of the present invention.

FIG. 10 shows data obtained from FIGS. 8 and 9, which indicate a relationship between a wavelength in the optical printer and effective coloring. Although the filter R is increased in transmittance as described above, it is substantially affected by an emission spectrum of the light source and sensitivity characteristics of emulsions for the film, so that intensity is reduced in order of green, blue and red.

This causes a ratio of the amount of exposure carried out for the same period of time using the same power supply to be as large as 1:4:2 among red, green and blue. In the prior art, control of luminance for varying an anode voltage of the printer head required to obtain red and green and blue luminous colors is carried out to adjust a ratio of luminance of the colors at 4:1:2, to thereby adjust a white balance. Alternatively, a speed of scanning or the number of times of scanning is varied to vary a period of time of exposure, to thereby adjust the white balance.

However, the above-described control by the anode voltage requires a circuit for adjusting a voltage of a power supply for a fluorescent display device, resulting in a power circuit being complicated. Also, the approach of varying the number of times of scanning to vary exposure time for every color, to thereby adjust the white balance causes a joint of the dot-like light to form a conspicuous line-like pattern, leading to a deterioration in quality of an image.

In view of the above while taking notice of the fact that a ratio of sensitivity with respect to the film is 1:4:2 among red, green and blue when the luminous dots of the printer heads are configured and arranged in the same manner, the illustrated embodiment is so constructed that the luminous dots of the printer head relatively decreased in sensitivity are increased in dimension in the sub-scanning direction and the reduction optical system is arranged so as to irradiate the luminous dots to the record medium while reducing a dimension of the luminous dots in the sub-scanning direction. Also, a magnification at which the dimension in the sub-scanning direction is enlarged and the reduction ratio in the sub-scanning direction by the reduction optical system are set for every luminous color. More specifically, the setting is carried out on the basis of a green luminous color exhibiting the highest sensitivity. In the printer head of a red luminous color, a dimension of the luminous dots in the sub-scanning direction is increased to a level of four times and the reduction optical system is arranged so as to reduce a dimension of the luminous dots to ¼. In the printer head of a blue luminous color, a dimension of the luminous dots in the sub-scanning direction is increased to two times and the reduction optical system is arranged so as to reduce a dimension of the luminous dots to ½.

Thus, it will be noted that the illustrated embodiment improves a relationship between a wavelength and effective coloring in the optical printer without carrying out any specific control during driving of the optical printer, resulting in the optical printer being improved in quality of an image and increased in printing speed.

As can be seen form the foregoing, the present invention permits a quantity of light to be increased without employing any specific means increased in cost such as an increase in dielectric strength of a drive IC. Also, the present invention permits a dimension of the luminous dots to be the same on the record medium through the reduction optical system, although it is enlarged in the sub-scanning direction, to thereby prevent a deterioration in resolution in the sub-scanning direction. Further, the present invention permits arrangement of the reduction optical system to be carried out utilizing a space of the conventional optical system, to thereby eliminate large-sizing of the optical printer.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An optical printer head comprising:

a first luminous element including a first plurality of luminous dots for a first color which have a first predetermined dimension in a sub-scanning direction and a second predetermined dimension in a main scanning direction wherein said first and second predetermined dimension are equal so that the first plurality of luminous dots are squared shaped said first plurality of luminous dots being spaced from each other in the main scanning direction; and a second luminous element including a second plurality of luminous dots for a second color which have a third predetermined dimension in the sub-scanning direction and a fourth predetermined dimension in the main scanning direction, wherein said third predetermined dimension is greater than the fourth predetermined dimension so that said second plurality of luminous dots are elongated in the sub-scanning direction, said second plurality of luminous dots being spaced from each other in the main scanning direction; and a reduction optical system for carrying out irradiation of light emitted from said second plurality of luminous dots of said second luminous element while reducing a dimension of the light in the sub-scanning direction.

2. An optical printer head comprising:

a first luminous element including first luminous dot arrays of a first color arranged in parallel to each other at a predetermined interval in a sub-scanning direction;

a second luminous element including second luminous dot-arrays of a second color arranged in parallel to each other at a predetermined interval in the sub-scanning direction;

said first luminous dot arrays each being constituted of a first plurality of luminous dots for the first color which have a first predetermined dimension in a sub-scanning direction and a second predetermined dimension in a main scanning direction, wherein said first and second predetermined dimension are equal so that the first plurality of luminous dots are squared shaped, said first plurality of luminous dots being spaced from each other in the main scanning direction; and said second luminous dot arrays each being constituted of a second plurality of luminous dots for the second color which have a third predetermined dimension in the sub-scanning direction and a fourth predetermined dimension in the main scanning direction, wherein said third predetermined dimension is greater than the fourth predetermined dimension so that said second plurality of luminous dots are elongated in the sub-scanning direction, said second plurality of luminous dots being spaced from each other at identical intervals in the main scanning direction;

said first and second plurality of luminous dots of each of said first and second luminous dot arrays being arranged in an offset manner while being deviated from each other in the main scanning direction by a distance equal to the dimension thereof in the main scanning direction; and a reduction optical system for carrying out irradiation of light emitted from said second plurality of luminous dots of said second luminous element while reducing a dimension of the light in the sub-scanning direction by a reciprocal of said predetermined magnification.

3. An optical printer comprising:

a record medium on which an image is formed by irradiation of light;

a plurality of luminous elements different in luminous color from each other for selectively irradiating dot-like light from a plurality of luminous dots arranged in a main scanning direction to said record medium;

a transfer means for transferring said luminous elements and record medium relatively to each other in a sub-scanning direction;

a control means for driving said transfer means and luminous elements in synchronism with each other;

said luminous elements including a luminous element of a first specific luminous color and of a second specific luminous color wherein said luminous element of said second specific luminous color emits dot-like light reduced in sensitivity as compared with the luminous element of said first specific luminous color;

a first luminous element including a first plurality of luminous dots for a first color which have a first predetermined dimension in a sub-scanning direction and a second predetermined dimension in a main scanning direction wherein said first and second predetermined dimension are equal so that the first plurality of luminous dots are squared shaped, said first plurality of luminous dots being spaced from each other in the main scanning direction; and said luminous element of the second specific luminous color including a second plurality of luminous dots which have a third predetermined dimension in the sub-scanning direction and a fourth predetermined dimension in the main scanning direction and, wherein said third predetermined dimension is greater than the fourth predetermined dimension so that said second plurality of luminous dots are elongated in the sub-scanning direction, and a reduction optical system for carrying out irradiation of light emitted from said second plurality of luminous dots while reducing a dimension of the light in the sub-scanning direction.

4. An optical printer as defined in claim 3, wherein said luminous elements include phosphors of red, green and blue luminous colors, respectively; and said luminous element of the second specific luminous color exhibits a red luminous color.

5. An optical printer as defined in claim 3, wherein said luminous elements each are a fluorescent luminous element including luminous dots each having a phosphor containing red, green and blue luminous color ingredients;

said luminous elements each emit dot-like light through filters of red, green and blue colors; and said luminous element of the second specific luminous color exhibits a red luminous color.

* * * * *